United States Patent [19]

Whitfield et al.

[11] Patent Number: 4,669,444

[45] Date of Patent: Jun. 2, 1987

[54] BALL TOSSING APPARATUS

[75] Inventors: Terry B. Whitfield, 2729 Carmar Dr., Los Angeles, Calif. 90046; Masami Shigeta, Tokyo, Japan

[73] Assignee: Terry B. Whitfield, Los Angeles, Calif.

[21] Appl. No.: 692,777

[22] Filed: Jan. 18, 1985

[51] Int. Cl.[4] ..... A63B 69/40

[52] U.S. Cl. ..... 124/16; 124/49; 124/51 R; 124/82; 221/203

[58] Field of Search ..... 124/16, 7, 50, 51 R, 124/49, 82; 273/26 D, 341, 29 A; 221/200, 202, 203, 277, 266

[56] References Cited

U.S. PATENT DOCUMENTS

| | | | |
|---|---|---|---|
| 3,208,444 | 9/1965 | Sipos | 273/341 X |
| 3,232,618 | 2/1966 | Anderson, Sr. | 273/341 |
| 3,446,199 | 5/1969 | Saveca | 124/16 |
| 3,602,208 | 8/1971 | Huerlimann | 273/26 D X |
| 3,610,223 | 10/1971 | Green | 124/50 X |
| 3,807,379 | 4/1974 | Vodinh | 273/26 D X |
| 3,841,294 | 10/1974 | McGill | 124/16 |
| 3,856,300 | 12/1974 | Payne | 124/16 X |
| 4,004,567 | 1/1977 | Henderson | 124/16 X |
| 4,052,065 | 10/1977 | Rodriquez | 273/341 |
| 4,402,507 | 9/1983 | Hudson | 124/16 X |

FOREIGN PATENT DOCUMENTS

| | | | |
|---|---|---|---|
| 2109495 | 5/1972 | France | 124/50 |

*Primary Examiner*—Paul E. Shapiro

*Attorney, Agent, or Firm*—Christie, Parker & Hale

[57] ABSTRACT

A ball tossing apparatus which automatically varies the direction of successive tosses is disclosed. The apparatus comprises a ball feeding unit and a ball tossing unit. The ball tossing unit comprises a housing which is pivotally mounted on a stand. A cam shaft is mounted in the housing and has a cam which extends through the bottom wall of the housing and rests on a tilt plate mounted on the stand. Rotation of the cam shaft and cam after each toss changes the tilt angle of the housing and therefore the direction of the next toss.

15 Claims, 5 Drawing Figures

BALL TOSSING APPARATUS

FIELD OF THE INVENTION

This invention relates to an automatic ball tossing apparatus or batting machine which propels a ball upwardly to a height where it can be hit by a batter and more particularly to a ball tossing machine capable of varying the location and/or height of successive tosses.

BACKGROUND OF THE INVENTION

Certain ball tossing apparatus or batting machines are designed to automatically propel balls upwardly from the apparatus to a height where they can be hit by a batter. Such machines are generally designed to operate continuously, i.e., unless deactivated they will continuously provide tosses at selected intervals.

Such ball tossing apparatus typically comprise a stationary housing with a means for propelling a ball upwardly mounted within the housing. In one type of ball tossing apparatus, the means for propelling a ball upwardly comprises a ball engaging member, e.g., a flexible strap, on which a ball introduced into the housing rests. The ball engaging member is moved from an upper position to a lower position against the force of a spring and then released so that the force of the spring causes the ball engaging member to rapidly return to its original upper position thereby propelling the ball upwardly out of the housing.

In such an apparatus, unless adjusted manually, the force of the spring is constant between successive tosses, and thus, the height of successive tosses is constant. Likewise, the upper and lower positions of the ball engaging member are generally constant. Because of this and the fact that the housing is stationary, the path or location of the ball on successive tosses is generally the same. This means that the height and location of successive tosses is totally predictable.

Since one of the purposes of a ball tossing apparatus as described above is to develop or enhance the hitting ability of a batter, there is a need to reduce the predictability of successive tosses to give a batter practice at hitting tosses which are inside and outside and are high and low as well as "down the middle".

SUMMARY OF THE INVENTION

Accordingly, there is provided a ball tossing apparatus comprising a housing, means mounted within the housing for automatically propelling a ball upwardly from the housing at selected intervals, and means for varying the direction of successive balls propelled from the housing.

In a preferred embodiment of the invention, the means for varying the direction of successive balls propelled from the housing comprises a rotatable cam shaft mounted in the housing and a cam fixedly attached to the cam shaft which extends through an opening in the bottom wall of the of the housing. Means for rotating the cam shaft a select fraction of a revolution after each ball is propelled up out of the housing are provided so that the housing is in a different tilt position, i.e., angle relative to the ground, for the next toss.

In a particularly preferred embodiment of the invention, the ball tossing apparatus comprises a stand having front and rear mounting brackets. The housing is mounted on the stand by means of front and rear coaxial pivot pins which rotatably engage the front and rear mounting brackets of the stand so that the housing is afforded a select degree of pivoting or rotating movement about the axis of the pivot pins. In such an embodiment, the stand comprises a tilt plate positioned beneath the bottom wall of the housing and the means for varying the direction of successive tosses comprises a rotatable cam shaft mounted within the housing having a cam which extends through an opening in the bottom wall of the housing and rests on the tilt plate. In this embodiment, the housing is supported by or rests on the front and rear pivot pins and the cam. The means for varying the direction of successive tosses further comprises means for rotating the cam shaft a select fraction of a revolution after each ball is propelled from the housing so that the housing assumes a new tilt position for each successive toss.

A preferred means for rotating the crank shaft comprises an overrunning clutch mounted on the cam shaft and having a plurality of spaced-apart longitudinally extending teeth. A clutch engaging shaft having spaced-apart circumferential ribs at one end for engaging the teeth of the overrunning clutch is mounted in the housing and afforded lengthwise movement between first and second positions whereby movement of the clutch engaging shaft from the first position to the second position results in rotation of the overrunning clutch, cam shaft and cam in one direction, and movement of the clutch engaging shaft from the second position to the first position causes only the overrunning clutch to rotate in the opposite direction.

The clutch engaging shaft is moved from its first position to its second position by a drive assembly. The drive assembly comprises a first gear. A second rotatable toothed gear is mounted in the housing at a position spaced apart from the first toothed gear and a chain extends around both gears. The chain comprises an outwardly extending tang which, as it travels around the path of the chain, engages one end of the clutch engaging shaft causing the clutch engaging shaft to move from its first to its second positions against the force of a spring. The tang releases the clutch engaging shaft as it travels around a gear.

In another particularly preferred embodiment of the invention, the housing is mounted on a stand by a ball and socket arrangement. The means for varying the direction of successive tosses comprises a first cam shaft mounted at one end of the housing comprising a first cam which extends through an opening in the bottom wall of the housing and rests on a first tilt plate of the stand, a second cam shaft mounted at the opposite end of the housing and having a second cam which extends through a second opening in the bottom wall of the housing rests on a second tilt plate of the stand, and means for rotating the first and second cam shafts selected fractions of a revolution after each toss.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION

Figure 1:
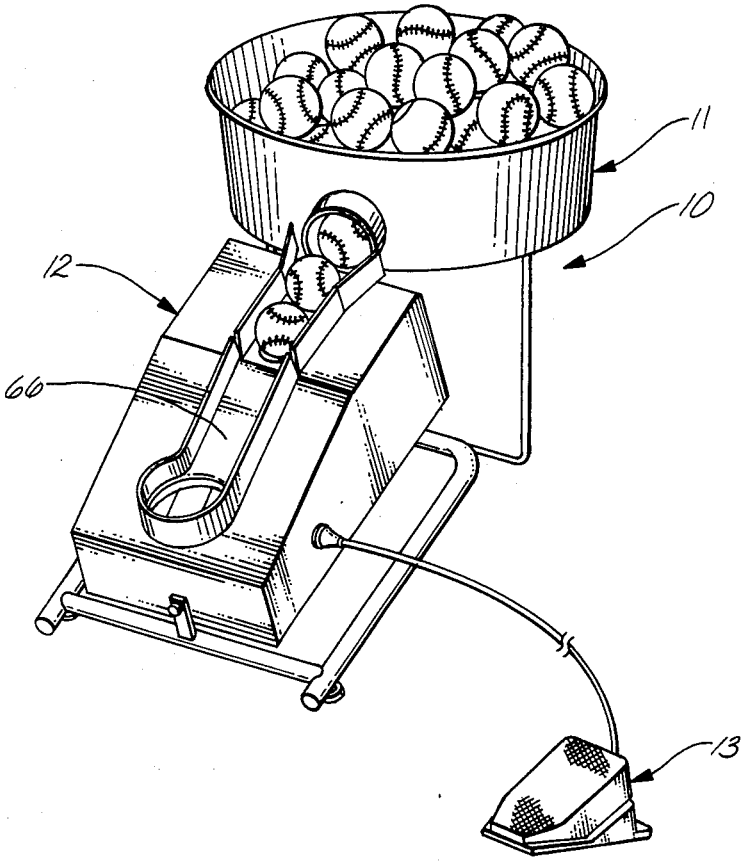
FIG. 1 is a perspective view of a preferred ball tossing apparatus.
Figure 2:
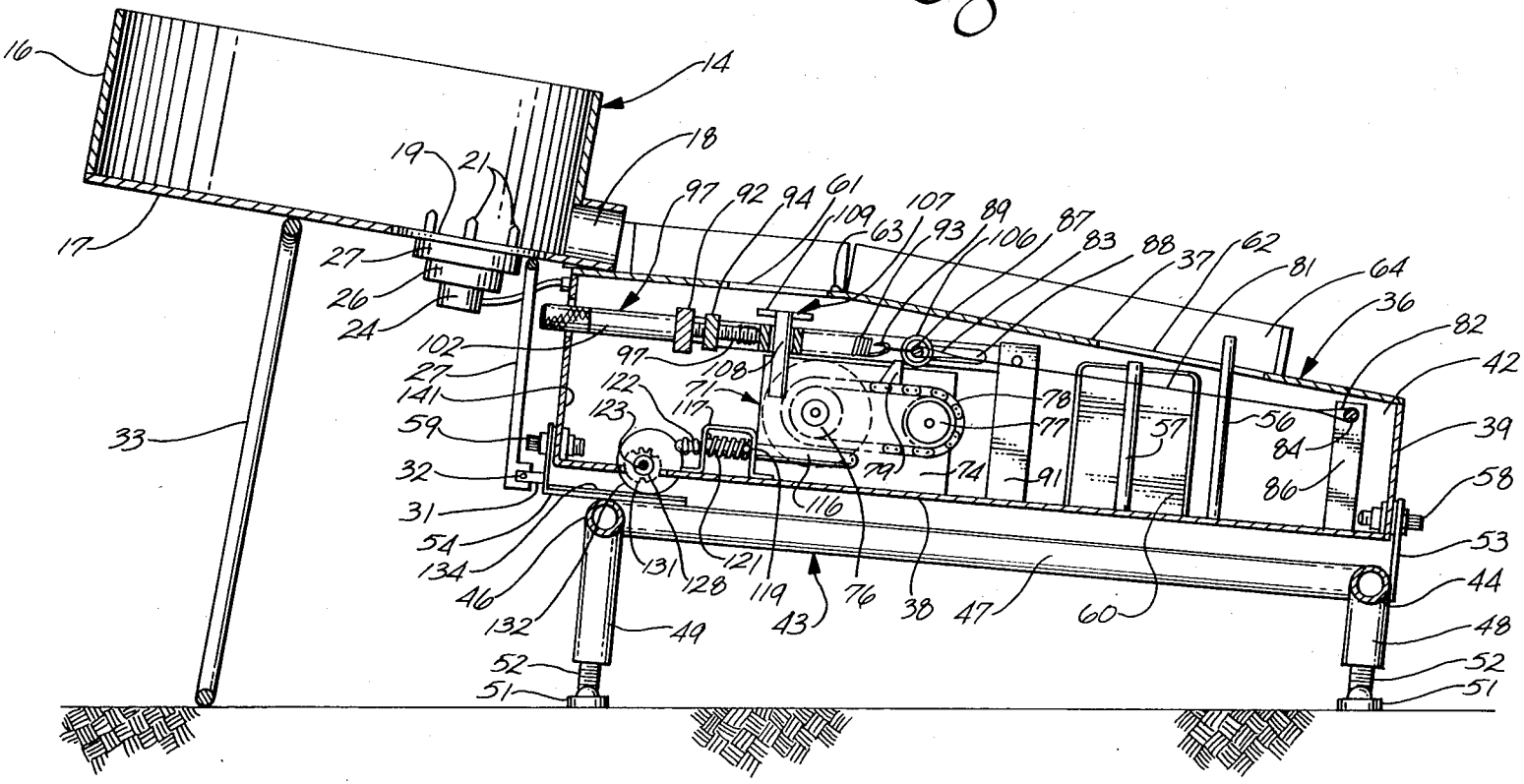
FIG. 2 is a side cross-sectional view of the ball tossing apparatus shown in FIG. 1.
Figure 3:
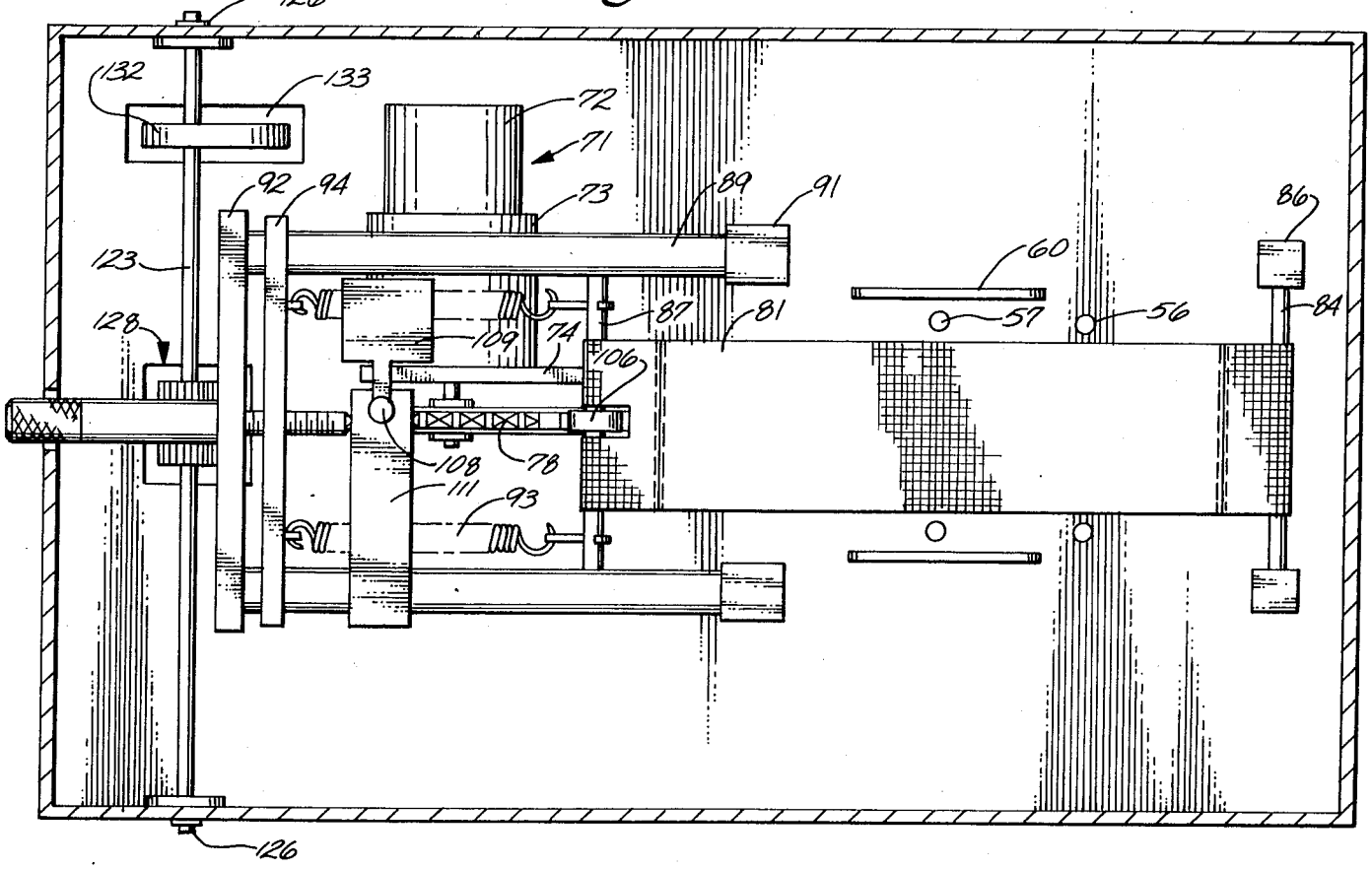
FIG. 3 is a top cutaway view of the ball tossing unit of the ball tossing apparatus shown in FIG. 1.

A particularly preferred automatic ball tossing apparatus constructed in accordance with the present invention is shown in FIGS. 1–3. The apparatus 10 comprises a ball feeding unit 11, a ball tossing unit 12 and a foot activation pedal 13.

The ball feeding unit 11 comprises a ball holding dish 14 having a generally cylindrical side wall 16 and a generally flat floor 17. A generally circular outlet port 18 is provided in the side wall 16 of the dish 14 at its front end. Balls are fed from the feeding unit 11 to the ball tossing unit 12 through the outlet port 18.

On the floor of the dish 14, adjacent the outlet port 18, is a rotatable feeding table 19. The feeding table 19 is generally circular and comprises a plurality of pins 21 which protrude upwardly from the table 19. The pins 21 are spaced apart a distance greater than the diameter of the balls.

When the feeding table 19 is rotated, the pins 21 prevent the balls from becoming tightly packed around the outlet port 18 so that jamming does not occur. In addition, the pins 21 contact and push balls adjacent the outlet port 18 into and through the outlet port 18 to assure continual feeding of balls to the ball tossing unit 12.

The ball feeding table 19 is rotated by means of a motor 24 and a gear reducer 26 mounted on the underside of the ball holding dish 14 by motor bracket 27. It is presently preferred that the ball feeding table 19 rotate at about 20 to 25 rpm, however other rates may be suitable.

The dish 14 is supported at its front end by a bracket 29 which can be releasably latched to a mating bracket 31 at the rear of the ball tossing unit 12 by means of a removable latch bar 32. The dish 14 is further supported by a wire stand 33. The height of the wire stand 33 is selected so that the floor of the dish 14 is at a slight inclination with the outlet port 18 at the bottom of the incline. In this arrangement, balls in the dish 14 roll forwardly toward the outlet port 18 as a result of gravity.

The ball tossing unit 12 comprises a housing 36 having top and bottom walls 37 and 38, front and rear walls 39 and 41, and a pair of side walls 42. The housing 12 is mounted on a stand 43 at an incline with the front end of the housing 36 at a lower elevation than the rear end. In this arrangement, balls fed from the ball feeding unit 11 onto the top wall 37 of the housing 36 roll forwardly down the top wall 37 of the housing 36.

The stand 43 comprises a generally rectangular tubular frame 45 having front and rear members 44 and 46 and a pair of side members 47. Bracket 31 is fixedly mounted on the rear member 46. The stand 43 further comprises a pair of short front legs 48 extending downwardly from the front member and a single longer rear leg 49 which extends downwardly from the center of the rear member 49 of the frame 45. An adjustable foot 51 is mounted on the bottom of each leg. The adjustable foot 51 has a threaded shaft 52 which threads into and out of a threaded opening at the bottom of each leg. The height of each leg can thus be independently adjusted by rotation of the foot 51.

The housing 36 is mounted on the stand 43 by means of front and rear mounting brackets 53 and 54 respectively. The front mounting bracket 53 is fixedly attached to and extends upwardly from the front member 44 of the tubular frame 45. The rear mounting bracket 54 is generally L-shaped and extends across most of the length of the rear section 46 of the tubular frame 45.

The housing 36 comprises pivot pins 58 and 59 which extend coaxially from the front and rear walls 39 and 41 of the housing 36 into corresponding holes in the front and rear mounting brackets 53 and 54. In this arrangement, the housing 36 pivots about pivot pins 58 and 59.

The top wall 37 of the housing 36 comprises a pair of generally circular openings, a smaller upper opening 61 and a larger lower opening 62. The diameter of the smaller upper opening 61 is less than the diameter of the balls and the lower opening 62 is larger than the diameter of the ball. A guide 64 extends forwardly from the upper rear edge of the top wall on either side of the upper opening 61 and around the lower opening 62. The guide 64 forms a chute 66 for receiving balls from the outlet port 18 of the ball feeding unit 11 and directing the balls to the first opening 61 and then to the second opening 62 in the top wall 37. The guide 64 forms a flared opening at the rear end of the top wall.

An upwardly protruding lip 63 extends along the lower or forward edge of the upper opening 61 to stop balls rolling down the chute 66. The lip 63 thus assures that the balls will come to rest initially in the upper opening 61.

When a ball is pushed out of the upper opening 61, as described in more detail infra, it rolls down the chute 64 and falls into the lower opening 62. Front guide bars 56 extend upwardly from the bottom wall of the housing 36 and protrude upwardly out of the lower opening 62. Guide bars 56 prevent balls rolling down the chute 64 from one shooting the lower opening and, along with shorter rear guide bars 57 and guide plate 60, guide the ball downwardly onto the flexible strap 91 and keep it there until it is propelled upwardly.

Within the housing 36, there is a drive assembly 71 comprising an electric motor 72 and a gear reducer 73 mounted on the bottom wall 37 of the housing 36 by the bracket 74. The electric motor assembly turns a first tooth gear 76. A second tooth gear 77 is rotatably mounted on the bracket 74 a select distance spaced apart forwardly from the first gear 76.

A chain 78 engages the first and second gears 76 and 77 so that rotation of the first gear 76 causes rotation of the second gear 77. The chain 78 comprises an outwardly extending, generally triangular tang 79. When the motor 72 is activated, the tang 79 travels clockwise along the oblong path of the chain 78 around the first and second gears 76 and 77.

A flexible strap 81 is mounted in the housing below the lower opening 62 in the top wall 37. The strap 81 has a front loop 82 at its forward end and a rear loop 83 at its rearward end. The forward loop 82 extends around a fixed rod 84 which extends between a pair of spaced-apart forward posts 86 adjacent the front wall 39 of the housing 36. The rearward loop 83 extends around a movable rod 87. The ends of the movable rod 87 slidably engage slots 88 in a pair of generally parallel spaced-apart mounting bars 89. The mounting bars 89 are fixedly mounted at their front ends to a pair of spaced-apart rearward posts 91 and extend rearwardly therefrom. At their rear ends, the mounting bars 89 are rigidly connected to each other by a fixed connecting plate 92.

The movable rod 87 is afforded slidable movement within the slots 88 between a rearward position above and rearward of the second gear 77 and a forward position above and forward of the second gear 77. The movable rod 87 is biased toward its rearward position by a pair of springs 93 which are attached to the movable rod 87 on opposite sides of the strap 81.

The springs 93 extend from the movable rod 87 rearwardly to an adjustable tension plate 94 which extends between the mounting bars 89. The tension plate 94 has openings at each end through which the mounting bars 89 extend. The openings are sufficiently large to afford the tension plate 94 movement along the length of the mounting bars 89. In this arrangement, the tension plate 94 is maintained in an orientation generally normal to the mounting bars 89 and parallel to the movable rod 87.

The tension of the springs 93 can be adjusted by means of an adjusting screw 97 having a threaded shaft 98 which extends through an non-threaded hole in the fixed connecting plate 92 and engages a threaded hole in the tension plate 94. The adjusting screw 97 comprises a handle 102 which abuts the fixed connecting plate 92 and extends rearwardly through an opening in the rear wall 41 of the housing 36.

The springs 93 bias the tension plate 94 forwardly maintaining the handle 102 in abutment with the fixed connecting plate 92.

Rotation of the adjusting screw 97 moves the tension plate 94 forwardly or rearwardly depending on the direction of the rotation. This either eases or increases the tension of the springs 93 and hence increases or decreases the rearward bias on the movable rod 87 and the strap 81.

A rotatable disk-shaped bearing 106 is mounted at about the midpoint of the movable rod 87 which extends through a center cutaway section of the rear loop of the strap 81. The bearing 106 extends sufficiently close to the chain 78 to be engaged by the tang 79 of the chain 78 as the tang 79 travels from the first gear 76 to the second gear 77.

The tang 79 engages the bearing 106 and causes the bearing 106, and hence the movable rod 87, to move forwardly. This generates slack in the strap 81 and the strap 81 bows downwardly. As the tang 79 travels around the second gear 77 it moves downwardly, releasing the bearing 106 and movable rod 87. The tension generated by the springs 93 causes the movable rod 87 to snap back to its rearward position causing the strap 81 to move rapidly from its downwardly bowed position to an upper taut position.

Thus, a ball resting on the strap 81 moves downwardly within the housing 36 as slack in the strap 81 is generated. When the tang 79 disengages the bearing 106, the strap 81 snaps back to its taut position causing the ball to be propelled upwardly out of the housing 33. The upward velocity on the ball and hence the height of the "toss" depends on the tension of the springs 93 which can be adjusted normally to provide either a high toss or a low toss.

Balls emerging from the ball feeding unit 11 roll down the chute 66 and settle in the upper opening 61 of the top wall 37 of the housing 36. The balls are then fed one at a time from the upper opening 61 to the lower opening 62 by means of a push plate mechanism 107 mounted within the housing 36 below the upper opening 61. The push plate mechanism 107 comprises a movable generally vertical push rod 108 having a push plate 109 at its upper end.

The push rod 108 is mounted on a bracket 111 which is fixedly attached to one mounting bar 89. The bracket 111 has a generally vertical hole positioned above and rearward of the first gear 76. The push rod 108 extends through the hole which is sufficiently large to afford the push rod 108 vertical movement therethrough between a lower position wherein the push plate 109 is below a ball resting in the upper opening 61 and an upper position wherein the push plate 109 pushes the ball out of the upper opening 61 and down the chute to the lower opening 62.

In the lower position, the bottom end of the push rod 108 is at an elevation about the same as the axis of the first gear 76 and is sufficiently close to the chain 78 for the tang 79 to engage the bottom and of the push rod 108 as the tang 79 travels around the first gear 76. When the tang 79 engages the bottom end of the push rod 108, it causes the push rod 108 to move upwardly into its upper position. If a ball is resting in the upper opening 61 of the top wall 37, the push plate 109 will engage the ball and push the ball out of the upper opening 61 and down the chute 66 toward the lower opening 62. As the tang 79 travels upwardly around the first gear 76 it moves forwardly, releasing the bottom end of the push rod 108 which then drops back to its lower position as a result of gravity.

Figure 4:
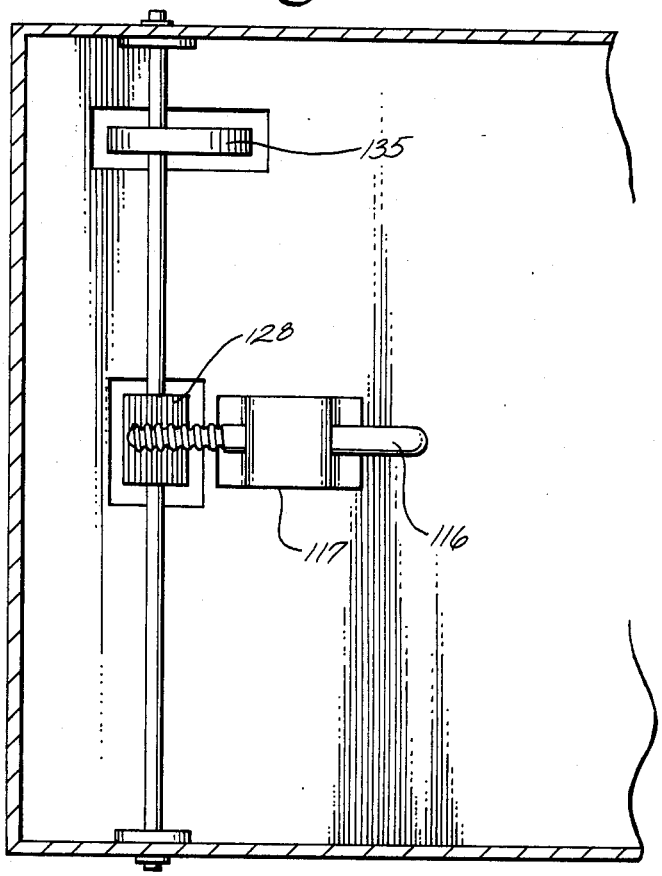
FIG. 4 is a top partially cutaway view of the tilting mechanism of the tossing apparatus shown in FIG. 1.

With respect to FIGS. 2–4, the ball tossing unit 12 further comprising a tilting mechanism 114. The tilting mechanism 114 comprises a clutch engaging shaft 116 which is mounted below the first gear 76 by a generally inverted U-shaped bracket 117 attached to the bottom wall 38 of the housing 36. The clutch engaging shaft 116 extends through both legs of the bracket 117 and is afforded lengthwise movement through the bracket 117. The clutch engaging shaft 116 has a hole along its length at a position between the legs of the bracket 117 through which a cotter pin 119 is disposed. A spring 121 is mounted in surrounding relation to the clutch engaging shaft 116 between the cotter pin 119 and the rear leg of the bracket 117. In this arrangement, the spring 121 biases the clutch engaging shaft 116 toward the front of the housing 36. The rear end of the clutch engaging shaft 116 comprises a plurality of spaced-apart circumferential ribs 122.

The clutch engaging shaft is afforded lengthwise movement between a forward position wherein the front end of the clutch engaging shaft 116 is below the first gear 76 sufficiently close to the chain 78 to be engaged by the tang 79 as it travels between the second gear 77 and the first gear 76 and a rearward position wherein the tang 79 releases the front end of the clutch engaging shaft 116 as the tang 79 travels upwardly around the first gear 76. When the tang 79 releases the clutch engaging shaft 116, it moves back to its forward position as a result of the force of the spring 121.

The tilting mechanism 114 further comprises a cam shaft 123 positioned below and rearwardly of the clutch engaging shaft 116 when the clutch engaging shaft 116 is in its forward position. The cam shaft 123 is generally perpendicular to the clutch engaging shaft 116 and extends across the width of the housing 36, the ends of the cam shaft 123 extending through the side walls 42 of the housing 36. The cam shaft 123 is afforded rotation movement but lengthwise movement of the cam shaft 123 is restricted by lock washers 126 which engage grooves in the ends of the cam shaft 123 at positions exterior of the housing 36.

A generally cylindrical overrunning clutch 128, e.g., a sprag clutch, is mounted on the cam shaft 123 at about its midpoint The overrunning clutch 128 comprises a plurality of spaced-apart teeth 131 which extend the length of the clutch 128 along its outer surface.

Rotation of the overrunning clutch 128 in one direction causes the cam shaft 123 to rotate in that direction. However, when rotated in the opposite direction, the overrunning clutch 128 releases the cam shaft 123 so that it does not rotate. Thus, when the clutch engaging shaft 116 moves from its forward position to its rearward position, the ribs 122 of the clutch engaging shaft 116 engage the teeth 131 of the overrunning clutch 128 and rotate the overrunning clutch 128 and cam chaft 123 about one-third turn. When the clutch engaging shaft 116 returns to its forward position, it causes the clutch 128 to rotate back to its original position. In this direction, however, the clutch 128 releases the cam shaft 123 so that it remains in its new position.

A cam 132 is mounted on the cam shaft 123 between the overrunning clutch 128 and the side of the housing 36 on which the motor 72 is mounted. The cam 132 protrudes through an opening 133 in the bottom wall of the housing 36 and rests on a generally flat tilt plate 134 which is mounted beneath the housing 36 on the rear mounting bracket 54. The center of gravity of the housing 36 and its contents is on the same side of the housing as the cam, but mostly to the weight of the motor 72 the cam 132 is always in contact with the tilt plate 134.

In this arrangement, as the tang 79 of the chain 78 travels from the second gear 77 to the first gear 76, it engages the front end of the clutch engaging shaft 116. As the tang continues to move rearwardly, it moves the clutch engaging shaft 116 rearwardly thereby rotating the overrunning clutch 128, cam shaft 123, and cam 132 about one-third turn. Since the cam 132 is eccentric-shaped, each time it is rotated, it causes the housing 36 to pivot on its pivot pins 58 and 59 to a new tilt position, the angle of the tilt depending on the distance between the cam shaft 123 and the surface of the tilt plate 134. As the tang 79 travels up around the first gear 76 it disengages the front end of the clutch engaging shaft 116 which then returns to its forward position ready to be engaged by the tang 79 on its next revolution.

Each time the tang 79 makes one revolution around the first and second gears 76 and 77, it activates the push plate mechanism 107 to release a ball from the upper opening 61 in the top wall of the housing 36. The ball then rolls down the chute 66 and drops through the lower opening 62 and onto the strap 81. The tang 79 then engages the movable rod 87 and moves it forwardly generating slack in the strap 81. When the tang 79 releases the movable rod 87, it snaps back rearwardly causing the strap 81 to become taut and which in turn generates upward momentum on the ball which is propelled up and out of the lower opening 62. The tang 79 then engages the clutch engaging shaft 116 which moves rearwardly turning the cam shaft 123 and cam 132 so that the housing 36 assures a new tilt position for the next "toss".

The ball tossing apparatus 10 is activated and deactivated by means of the foot activtion pedal 13.

This invention has the unique advantage of providing a ball tossing apparatus which can vary the toss angle of consecutive tosses. This will give a batter experience in hitting balls at different locations, relative to where the batter stands, e.g., inside, outside or "down the middle" tosses. If a net is provided into which the ball is hit, the space required for batting practice is small—so small that the apparatus can be used indoors as well as outdoors.

The preceding description has been presented with reference to the presently preferred embodiment of the invention shown in the accompanying drawings. Workers skilled in the art and technology to which this invention pertains will appreciate that alterations and changes in the described apparatus and structure can be practiced without meaningfully department from the principles, spirit and scope of this invention.

For example, in the embodiment described above, any suitable electrical switch, either remote or located in the housing, can be used to activate and deactivate the motor. Rather than have separate motors for the drive assembly and the feeding table, only one motor need be used. In such an embodiment, the feeding table is connected to the drive assembly motor by any suitable means, e.g., a bell crank arrangement. If desired, the stand can be equipped with rollers or wheels for ease in transport.

If it is desired that the toss be disguised, the apparatus may simply comprise a stationary housing with the interior components mounted on a floor which pivots as described above within the stationary housing.

Figure 5:
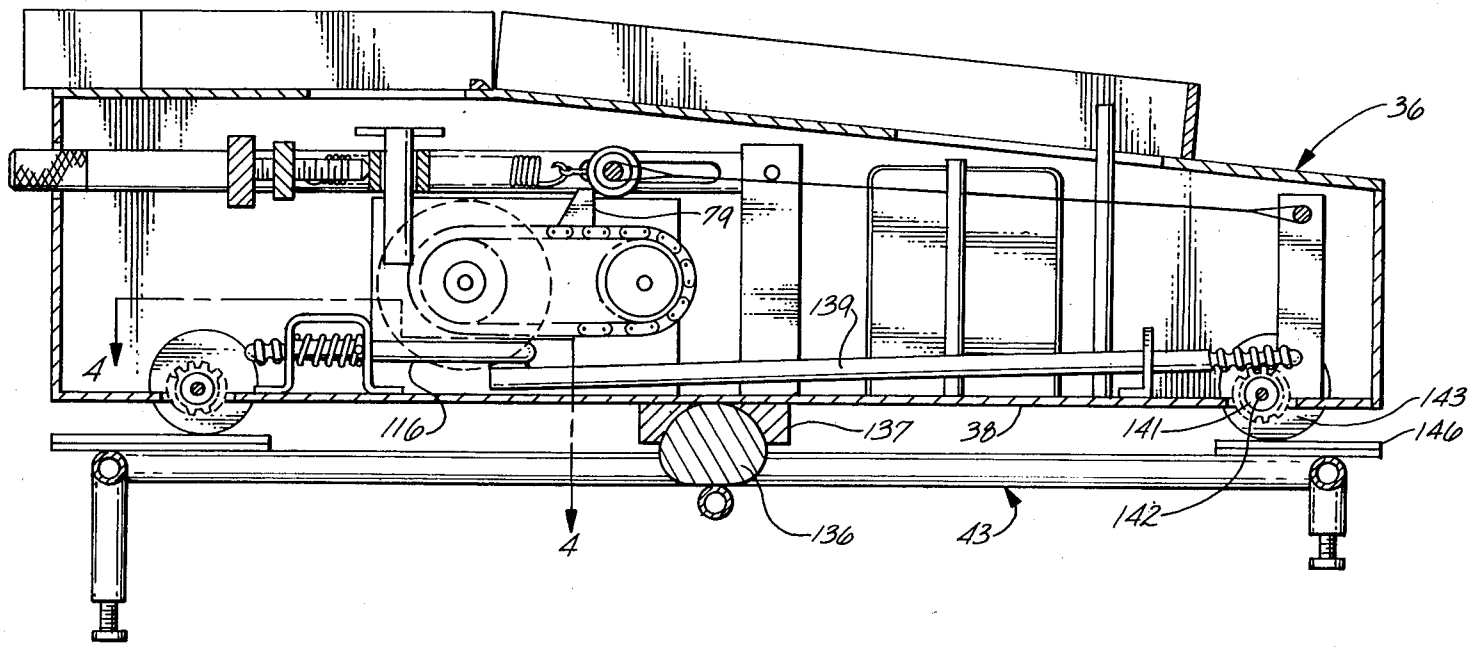
FIG. 5 is a side cross-sectional view of another preferred ball tossing unit.

If desired, the housing can pivot front-to-rear as well as from side-to-side. With reference to FIG. 5, in such an embodiment, the housing 36 is mounted on the stand 43 by a ball and socket arrangement, e.g., a ball 136 mounted on stand 43 which fits into a socket 137 in underside of the bottom wall 38 of the housing 36 as shown. The tilting mechanism 138 is generally as described above but also comprises a second clutch engaging shaft 139 which is attached to the first clutch engaging shaft 116 and extends forwardly to the front end of the housing 36 where it engages a second overrunning clutch 141 on a second cam shaft 142 generally in the same manner as the first clutch engaging shaft 116 engages the first overrunning clutch 128. The second cam shaft 142 has a second cam 143 which extends through a second opening in the bottom wall of the housing 36 and rests on a second tilt plate 146 mounted on the stand 43. The second cam 143 is on the same side of the housing 36 as the first cam 132 so that the housing 36 always rests on the first and second cams 132 and 143 and the ball 136.

Thus, when the tang 79 engages and moves the first clutch engaging shaft 116 rearwardly, both cam shafts and cams are rotated. This results in consecutive tosses varying not only from side-to-side, e.g., inside to outside, but also varying up and down, e.g., high to low.

In such an embodiment, it is preferred that the outer diameter of the second overrunning clutch 141 be different than the outer diameter of the first overrunning clutch 128 so that the cam shafts 123 and 142 and the cams 132 and 143 rotate at different rate which in turn greatly increases the number of variations in the tosses.

In the embodiment described above, the mechanism for generating upward momentum on the ball is a strap which is slackened against the force of a spring. It is apparent that other means for generating upward momentum on the ball as are well known in the art may be equally suitable.

Also, if desired, the drive assembly may comprise a conventional wind-up mechanism, rather than a motor, so that the ball tossing apparatus can be used without the need of an electrical outlet.

Accordingly, the foregoing description should not be read as pertaining only to the precise structures and procedures described, but rather should be read consistent with and as support for the following claims which are to have their fullest fair scope.

What is claimed is:

1. A ball tossing apparatus comprising:

a housing;

means, mounted in the housing, for automatically propelling a ball upwardly from the housing to a select height above the housing at selected intervals;

means for changing the tilt angle of the housing which comprises;

a stand for pivotally supporting the housing, said stand having a tilt plate;

a rotatable cam mounted within the housing and extending beneath the housing and engaging the tilt plate; and means for rotating the cam a select fraction of a revolution after each ball is propelled from the housing.

2. A ball tossing apparatus comprising:

a stand comprising front and rear mounting brackets;

a housing comprising a front and rear coaxial pivot pins which rotatably engage the front and rear mounting brackets of the stand respectively so that the housing is afforded pivotal movement about the axis of the pivot pins;

means, mounted in the housing, for automatically propelling a ball upwardly from the housing to a select height above the housing at select intervals;

switch means for activating and deactivating the automatic ball propelling means; and means for automatically pivoting the housing about the axis of the pivot pins to thereby change the tilt angle of the housing after each ball is propelled upwardly from the housing.

3. A ball tossing apparatus as claimed in claim 2 wherein the stand comprises two short front legs and a long rear leg, the height of each leg being adjustable.

4. A ball tossing apparatus as claimed in claim 2 wherein the stand comprises a tilt plate positioned beneath the housing and the means for automatically changing the tilt angle of the housing comprises:

a rotatable cam shaft mounted within the housing;

a cam fixedly attached to the cam shaft at a position laterally spaced apart from the axis of the pivot pins, said cam extending through the bottom wall of the housing and engaging the tilt plate so that the housing is supported on the stand by the front and rear pivot pins and by the cam; and means for rotating the cam shaft a select fraction of a revolution after each ball is propelled from the housing.

5. A ball tossing apparatus as claimed in claim 4 wherein the means for rotating the cam shaft comprises:

an overrunning clutch having a plurality of longitudinally extending teeth about its outer circumference mounted on the cam shaft;

a clutch engaging shaft having a plurality of circumferential ribs for engaging the teeth of the overrunning clutch, said clutch engaging shaft being mounted in the housing and afforded lengthwise movement between a first position and a second position wherein movement of the clutch engaging shaft from the first position to the second position causes the overrunning clutch, cam shaft, and cam to rotate in one direction a select fraction of a revolution, and movement of the clutch engaging shaft from the second position to the first position causes only the overrunning clutch to rotate in the opposite direction back to its original position; and means for moving the clutch engaging shaft between its first and second positions.

6. A ball tossing apparatus as claimed in claim 5 wherein the means for moving the clutch engaging shaft between its first and second positions comprises:

a rotatable gear having an outwardly protruding tang mounted within the housing at a position wherein the tang engages one end of the clutch engaging shaft during each revolution and moves the clutch engaging shaft from its first to its second position and then releases the clutch engaging shaft;

drive means for rotating the gear; and a spring mounted within the housing which biases the clutch engaging shaft toward its first position so that when the tang releases the clutch engaging shaft, the clutch engaging shaft returns to its first position.

7. A ball tossing apparatus as claimed in claim 6 wherein the drive means comprises an electric motor.

8. A ball tossing apparatus as claimed in claim 6 wherein the drive means comprises a wind up mechanism.

9. A ball tossing apparatus as claimed in claim 2 wherein the stand comprises front and rear tilt plates, and the housing is mounted on the stand in a ball and socket arrangement, and wherein the means for automatically changing the tilt angle of the housing comprises:

a first cam shaft mounted within the housing adjacent the front of the housing having a first cam which extends beneath the housing and contacts the front tilt plate;

a second cam shaft mounted within the housing adjacent the rear of the housing having a second cam which extends beneath the housing and contents to the rear tilt plate; and means for rotating the first and second cam shafts a select fraction of a revolution after each ball is propelled from the housing.

10. A ball tossing apparatus as claimed in claim 4 wherein the means for rotating the cam shaft comprises:

a first overrunning clutch having a plurality of longitudinally extending teeth about its outer circumference mounted on the first cam shaft;

a second overrunning clutch having a plurality of longitudinally extending teeth about its outer circumference mounted on the second cam shaft;

a first clutch engaging shaft having a plurality of circumferential ribs for engaging the teeth of the first overrunning clutch, said first clutch engaging shaft being mounted in the housing and afforded lengthwise movement between a first position and a second position wherein movement of the first clutch engaging shaft from the first position to the second position causes the first overrunning clutch, first cam shaft, and first cam to rotate in one direction a select fraction of a revolution, and movement of the first clutch engaging shaft from the second position to the first position causes only the first overrunning clutch to rotate in the opposite direction back to its original position;

a second clutch engaging shaft having a plurality of circumferential ribs for engaging the teeth of the second overrunning clutch, said second clutch engaging shaft being mounted in the housing and afforded lengthwise movement between a third position and a fourth position wherein movement of the second clutch engaging shaft from the third position to the fourth position causes the second overrunning clutch, second cam shaft, and second cam to rotate in one direction a select fraction of a revolution, and movement of the second clutch engaging shaft from the fourth position to the third position causes only the second overrunning clutch to rotate in the opposite direction back to its original position; and means for moving the first clutch engaging shaft between its first and second positions and the second clutch engaging shaft between its third and fourth positions.

11. A ball tossing apparatus as claimed in claim 5 wherein the first and second clutch engaging shafts are rigidly connected together and the means for moving the first clutch engaging shaft between its first and second positions comprises:

a rotatable gear having an outwardly protruding tang mounted within the housing at a position wherein the tang engages one end of the first or second clutch engaging shaft during each revolution and moves the first clutch engaging shaft from its first to its second position and the second clutch engaging shaft from its third position to its fourth position and then releases the clutch engaging shaft;

drive means for rotating the gear; and a spring mounted within the housing which biases the first clutch engaging shaft toward its first position and the second clutch engaging shaft toward its third position so that when the tang releases the first or second clutch engaging shaft, the first clutch engaging shaft returns to its first position and the second clutch engaging shaft returns to its third position.

12. A ball tossing apparatus as claimed in claim 11 wherein the drive means comprises an electric motor.

13. A ball tossing apparatus as claimed in claim 11 wherein the drive means comprises a wind-up mechanism.

14. A ball tossing apparatus comprising:

a ball feeding unit which comprises:

a ball holding disk having an outlet port;

a rotatable ball feeding table adjacent the outlet port having a plurality of upwardly protruding pins for preventing jamming of balls within the ball holding disk at the outlet port; and means for rotating the ball feeding table;

a ball tossing unit which comprises:

a stand having front and rear bracket and a tilt plate;

a housing having front and rear coaxial pivot pins for rotatably engaging the front and rear brackets of the stand, said housing having front, rear, top bottom and side walls, wherein the top wall extend forwardly and downwardly and receives balls from the ball feeding unit and has an upper opening having a first diameter less than the diameter of the outlet port, and a lower opening having a diameter greater than the first diameter and a guide for directing balls received from the ball feeding unit to the upper opening and then to the lower opening;

a drive assembly mounted within the housing comprising:

a motor;

a first gear rotated by the motor;

a second rotatable gear mounted in the housing at a position spaced apart from the first gear;

a chain extending around the first and second gears and comprising an outwardly extending tang;

a strap assembly comprising:

a fixed rod forward of the lower opening;

movable rod rearward of the lower opening movable between a forward position and a rearward position;

a spring which biases the movable rod toward its rearward position;

a flexible strap attached at one end to the fixed rod and attached at its other end to the movable rod, said strap being taut when the movable rod is in its rearward position;

wherein the movable rod is positioned sufficiently close to the chain to be engaged by and to be moved from its rearward position to its forward position by the tang as the tang travels forwardly along the path of the chain and then released by the tang each time the tang makes a revolution around the path of the chain;

a push plate assembly comprising:

a push rod having a push plate at its upper end mounted in the housing below the upper opening, said push rod being movable between a lower position wherein the push plate is below a ball resting in the upper opening and an upper position wherein the push plate engages a ball resting in the upper opening and pushes the ball out of the upper opening;

wherein the lower end of the push rod is sufficiently close to the chain to be engaged by and to be moved from its lower to its upper position by the tang as it travels upwardly along the path of the chain and then released by the tang each time the tang makes a revolution around the path of the chain;

a tilt assembly comprising:

a rotatble cam shaft mounted in the housing comprising a cam along the length of the cam shaft at a position laterally spaced apart from the axis of the pivot pins, said can extending through the bottom wall of the housing and contacting the tilt plate, the housing thereby resting on the pivot pins and the cam, said cam shaft further comprising an overrunning clutch using a plurality of longitudinally extending spaced-apart teeth;

a clutch engaging shaft having a plurality of circumferential ribs at its rearward end for engaging the teeth of the overrunning clutch, said clutch engaging shaft being mounted in the housing and afforded lengthwise movement between a forward position and a rearward position wherein movement of the clutch engaging shaft from the forward position to the rearward position casues the overrunning clutch, cam shaft, and cam to rotate in one direction a select fraction of a revolution, and movement of the clutch engaging shaft from the rearward position of the clutch engaging shaft from the rearward position to the forward position causes only the overrunning clutch to rotate in the opposite direction back to its original position;

a spring which biases the clutch engaging shaft toward its forward position; and wherein the forward end of the clutch engaging shaft is sufficiently close to the chain to be engaged by and to be moved from its rearward position by the tang as the tang moves rearwardly along the path of the chain and to then be released by the tang each time the tang makes a revolution around the path of the chain.

15. A tossing apparatus comprising:

a housing;

means within the housing for automatically propelling an object upwardly to a select height above the housing at selected intervals; and a stand for pivotally supporting the housing, said stand having a tilt plate;

rotatable cam mounted within the housing and extending beneath the housing and engaging the tilt plate; and means for rotating the cam a select fraction of a revolution after each selected interval.

* * * * *